United States Patent [19]

Merry

[11] Patent Number: 5,042,227

[45] Date of Patent: Aug. 27, 1991

[54] METHOD & APPARATUS FOR COMPRESSION PACKAGING

[75] Inventor: Wayne M. Merry, St. Catherines, Canada

[73] Assignee: 659897 Ontario Limited, St. Catherines, Canada

[21] Appl. No.: 451,051

[22] Filed: Dec. 15, 1989

[51] Int. Cl.[5] ..... B65B 63/02

[52] U.S. Cl. ..... 53/438; 53/442; 53/436; 223/57

[58] Field of Search ..... 53/436, 438, 121, 529, 53/439, 442; 223/57; 100/35

[56] References Cited

U.S. PATENT DOCUMENTS

| | | | |
|---|---|---|---|
| 2,134,930 | 11/1938 | Reynolds | 128/285 |
| 2,336,744 | 12/1943 | Manning | 18/1 |
| 2,425,004 | 8/1947 | Rabell | 18/5 |
| 2,444,528 | 7/1948 | Popper et al. | 128/285 |
| 2,462,178 | 2/1949 | Ganz | 18/5 |
| 2,659,935 | 11/1953 | Hammon | 18/55 |
| 2,952,462 | 9/1960 | Planin | 273/157 |
| 3,189,669 | 6/1965 | Goldfein | 264/134 |
| 3,306,966 | 2/1967 | Matejcek | 264/321 |
| 3,342,922 | 9/1967 | Karpovich et al. | 264/321 |
| 3,504,064 | 3/1970 | Bauer | 264/28 |
| 4,096,230 | 6/1978 | Haerr | 264/321 |
| 4,168,599 | 9/1979 | King | 53/529 X |
| 4,241,007 | 12/1980 | Tanaka et al. | 264/324 |
| 4,377,061 | 3/1983 | Olson | 53/529 X |
| 4,529,569 | 7/1985 | Palau | 264/321 |
| 4,577,453 | 3/1986 | Hofeler | 53/438 |
| 4,757,669 | 7/1988 | Areblom | 53/526 X |

FOREIGN PATENT DOCUMENTS

| | | | |
|---|---|---|---|
| 2084954 | 4/1982 | United Kingdom | 53/121 |

*Primary Examiner*—John Sipos

*Attorney, Agent, or Firm*—Rogers, Bereskin & Parr

[57] ABSTRACT

The present invention provides a method of compacting a sheet article, for example an article of underwear, to produce a stable, substantially rigid, compacted article. This reduces space required for storage and distribution and facilitates packaging of the article. Compaction is effected by placing the article, or a plurality of articles, in a mould cavity, and subjecting them to elevated pressure for a certain time. The pressure and time are selected to compact the article sufficiently to form the stable, rigid body, but simultaneously not being so great as to either damage the article or compact it so much that water or other liquid is required to recover the article from its compacted state to its original state.

14 Claims, 1 Drawing Sheet

METHOD & APPARATUS FOR COMPRESSION PACKAGING

FIELD OF THE INVENTION

This invention relates to a method of compressing woven sheet articles, and such woven sheet articles when compressed. More particularly, it relates to a method of compressing such sheet articles into a compact form, which the article will retain after removal of the applied pressure but which will enable a user to return the sheet article to its original condition without the use of water or other liquid.

BACKGROUND OF INVENTION

At the present time, there are a variety of known techniques for compressing fibrous articles, but no known techniques provide for compressing a woven sheet article such that it can be returned to its original condition without the use of some liquid agent.

U.S. Pat. No. 2,659,935 (Hammon); U.S. Pat. No. 2,952,462 (Planin); U.S. Pat. No. 3,306,496 (Matejcek); U.S. Pat. No. 3,189,669 (Goldfein); U.S. Pat. No. 3,342,922 (Karpovich et al.); U.S. Pat. No. 3,504,064 (Bauer); and U.S. Pat. No. 4,529,569 (Palau) generally relate to methods for compressing a sponge material to a compacted, stable condition. A variety of techniques are disclosed in these patents, depending upon the application of different agents, adhesives and temperatures and pressures. However, it is noteworthy that in all these proposals, some sort of liquid agent, usually water, is required to return the sponge article to its original expanded condition. Further, in all of these patents, except for the Planin Patent, U.S. Pat. No. 2,952,462, the article has approximately the same configuration in the compressed and expanded conditions; the Planin Patent is concerned with the sponge articles, such as a toy duck, which is compressed into a different form e.g. a circular disc. Some of the patents, e.g. the Bauer U.S. Pat. No. 3,504,064 require even more extreme conditions to return the article to its original shape, e.g. the application of both heat and steam. It is also noteworthy that these patents are concerned with a sponge material, rather than woven sheet material.

There are also a number of patents relating to machines and methods of making tampons. US patents showing such methods are U.S. Pat. No. 2,134,930 (Reynolds); U.S. Pat. No. 2,336,744 (Manning); U.S. Pat. No. 2,425,004 (Rabell); and U.S. Pat. No. 2,462,178 (Ganz). These patents disclose a variety of different techniques for compressing fibrous material to form tampons. There are some notable differences from the present invention. Thus, the material used is loose fibrous material, as exemplified by the Manning Patent in which fibrous material enters through an opening and is deposited on a screen where air pressure causes it to form the pads. Further, in the nature of the product, there is no necessity for the product to be able to resume any original, un-compressed state in the absence of moisture. Further, many of these patents disclose quite elaborate folding or forming techniques, e.g. the Rabell Patent, whereas as detailed below the present invention does not require such careful folding or forming of the un-compressed article.

U.S. Pat. No. 4,096,230 is another example of a sponge material which is compressed and is capable of returning to an un-compressed condition. This again relies upon the use of moisture to return to its original shape. The article is a dehydrated prosthesis, for insertion end-wise into a body opening, e.g. the ear canal, where it absorbs moisture and returns to its original shape.

In the art of packaging woven sheet articles, a number of suppliers from the far East have developed techniques for compressing sheet articles under pressure to a compacted, solidified form, which is stable after the pressure has been released. However, this technique requires the article to be soaked in water, for its return to its original loose, un-compressed state. In general, the technique used is somewhat crude, with the applied pressure and other parameters not being significantly controlled, and indeed in many cases the operators are unaware of the exact conditions to which the articles are subjected. This technique is applied to such articles as face cloths, where clearly it is acceptable for them to be soaked in water to return the article to its original state in which it could be used. Since a face cloth is in any event wetted prior to use, this is no disadvantage.

U.S. Pat. No. 4,241,007 (Tanaka et al.) is an example of a technique for producing a compressed cloth-like article, which can be returned to its original state by absorption of water. Thus, this patent is intended for use on face cloths and the like. The patent suggests the use of very high pressures, in the range of 1,100 to 1,500 kilograms per square centimeter, preferably 1,200–1,300 kilograms per square centimeter. The larger range is equivalent to pressures in the range 15,640 to 21,330 psi, which is a very high pressure. In the light of the results discovered by the present applicant, discussed below, these pressures are surprising. In very general terms, applicant has discovered that, for a variety of materials, pressures in excess of a few thousand psi resulted in damage to the article. This U.S. Patent does refer to a published Japanese utility model Application No. 36,565/1977 which utilises a pressure as low as 30 kilograms per square centimeter, or approximately 425 psi. Again, this apparently is for an article which can be recovered to its original state by absorbing water. It is also noted that this Tanaka patented discusses in the examples the use of a binderless cellulosic non-woven fabric, which is somewhat different from the materials used by the present applicant. It is further noted that binderless cellulosic non-woven fabric appears to be higher in compression elasticity, thereby requiring higher pressures to ensure a well compressed product which is not wrinkled at the edges. Indeed, the example uses a control at a pressure 1,000 kilograms per square centimeters to show that the compression and moulding is inadequate at this pressure.

However, it will readily be appreciated that for many articles the technique of wetting a compressed article as purchased, in order to return it to an original un-compressed condition for use is entirely unacceptable. In effect, a user would have to wet the article to loosen and expand it, and then dry the article.

There are many articles for which it would be desirable to apply such a compression packaging technique. Articles such as socks, underwear, pantyhose are all relatively expensive to package. Indeed, for a product such as pantyhose, large amounts of money, time and effort are expended in developing satisfactory packaging techniques, which nonetheless require a significant amount of manual labour in the packaging of the product. Many of these articles are of relatively low cost, so that the packaging cost can be significant.

SUMMARY OF THE PRESENT INVENTION

In accordance with the present invention, there is provided a method of compressing a woven sheet article to produce a solid, stable compacted article, the method comprising:

(a) placing the sheet article in a mould;

(b) subjecting the sheet article to an elevated pressure in the mould for a certain time, which pressure and time are selected so that the sheet article is compressed to form a stable, substantially rigid body, which retains substantially the shape of the mould after removal therefrom and which can be returned to its original un-compressed condition by manipulation thereof and without addition of any liquid;

(c) removing the compressed article from the mould.

Thus, in contrast to the prior art, the present invention is intended to provide a compressed woven sheet article which can be returned to its original state without having to soak it in water or other liquid. This enables the technique to be applied to a variety of commonly available articles, such as socks, underwear, pantyhose.

When such articles are compressed by the method of the present invention, they assume a compact shape which makes subsequent packaging steps quite simple. For example, if a pair of socks is compressed into a solid, generally disc-shape, then they can be packaged simply by being shrink-wrapped in a plastic film, with appropriate markings included on it or on a separate identification sheet. Further, during the compression step, there is no need for the socks or other articles to be folded in any particular manner. They could simply be dropped loosely into a cavity in a mould, thereby eliminating the necessity for any careful folding, etc. Nonetheless, in the compressed state, they provide a neat and tidy appearance.

A further advantage of compressing many woven articles is that it greatly reduces the space required for storage and transportation. Thus, many woven articles are of a relatively low density and require a lot of space for transportation and storage. When compressed by the method of the present invention, the storage and transportation problems are reduced, thereby saving on costs. Further, when articles such as socks are in a compressed, relatively solid form, they are easier to handle during storage and transportation.

Whilst the invention is primarily applicable to woven sheet articles, e.g. items of clothing, it is also envisaged that it could be applied to other articles, e.g. disposable or cloth baby diapers. In this case, an appropriately shaped mould would be provided, and the diapers would be compressed to reduce their bulk for packaging and storage. The end user would open up the diaper and by manipulation restore it to its expanded or un-compressed condition.

DESCRIPTION OF THE DRAWING FIGURES

For better understanding the present invention and to show more clearly how it may be carried into effect, reference will now be made, by way of example, to the accompanying drawings in which, FIG. 1 is a sectional view of a mould for carrying out the method of the present invention, including an article to be compressed;

FIG. 2 is a perspective view of an article after compression in the mould of FIG. 1; and FIG. 3 is a planned view of the compressed article of FIG. 2, after enclosure in packaging.

DESCRIPTION OF THE PREFERRED EMBODIMENT

Figure 1:
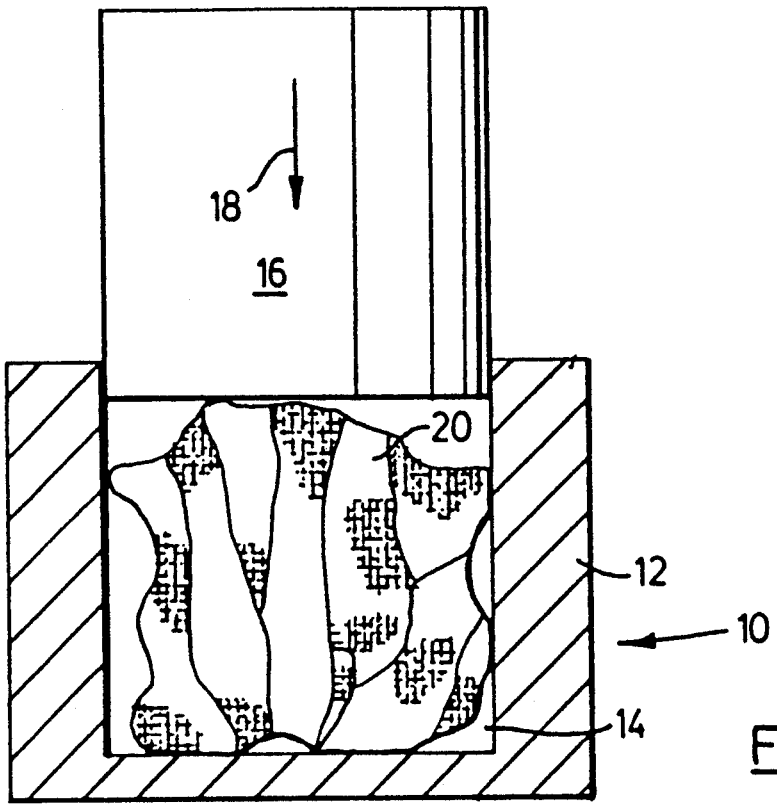

Referring first to FIG. 1, there is shown a mould, generally indicated by the reference 10. The mould 10 has a lower mould part or body 12, which defines a generally cylindrical cavity 14. The cavity 14 is closed at this lower end. A plunger on piston 16 is also cylindrical and is dimensioned to form a close sliding fit in the cavity or bore 14.

As indicated by the arrow 18, the plunger 16 is mounted to be pressed downwardly into the cavity 14. However, it will be appreciated that, in known manner, it is immaterial which of the mould body 12 and plunger 16 move, and indeed both elements can be moved simultaneously towards one another.

A woven sheet article is indicated schematically at 20. The sheet article is simply dropped into the cavity 14, so that no part of it extends out of the cavity 14. In accordance with the present invention, it need not be necessary for the sheet article 20 to be folded in any way. The plunger 16 is then inserted into the top of the cavity 14, and a desired pressure applied to it. Once this pressure has been applied, it is held for a predetermined time.

In accordance with the present invention, and as discussed below in relation to specific examples, the pressure and time are selected so as to compact the article sufficiently to form a generally stable, solidified body, but simultaneously the compression is not so great as to prevent the article being returned to its original shape by an end user. In this respect, for some applications, it may be sufficient that the article is sufficiently compressed to be stable for only a relatively short time after removal from the mould 10. The article is then packaged in a close fitting package, which maintains the article in its compressed state. For other articles or applications, it can be preferred to compress the article sufficiently that it will retain a compressed, stable configuration for a long period of time. An important factor in determining an article's ability to retain a compressed condition is the tendency for the article to absorb moisture. This in turn both depends on the material of the article and how well it is protected from moisture. Thus, suitable packaging can assist in retaining the compressed state simply by preventing moisture from being absorbed.

To return the article to its original, un-compressed condition, where the article is in an individual package, the packaging is first removed. The user then simply pulls the article out of its compressed shape, by pulling on loose edges or corners of the article upon the exterior of the compressed article 22. With most articles, this can be done readily and simply. Certain articles, e.g. those formed from delicate fabrics, a certain degree of care may be required. Nonetheless, it is a simple matter for a user to pull the article out of its compressed state and return it to its original un-compressed state.

As a result of the compacting of the article, it will then almost certainly have been extensively creased. However, for many articles this is immaterial, e.g. underwear, or alternatively the creases will quickly disappear. Thus, for articles such as socks and pantyhose, the presence of creases is immaterial, since they effectively disappear once they are worn. For other articles such as shop cloths, the presence of creases is immaterial to their function, or their appearance is immaterial.

Figure 2:
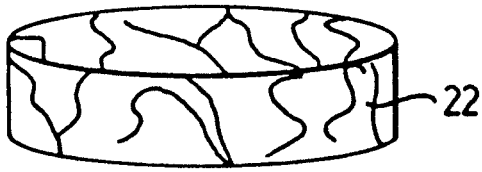
Figure 3:
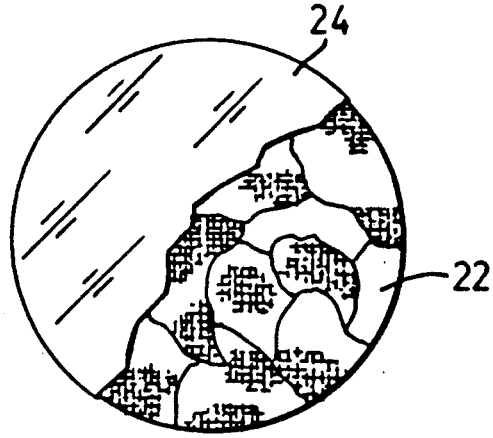

FIG. 3 shows a plan view of the article 22 in the compressed or compacted condition of FIG. 2, when provided with packaging 24. The packaging 24 comprises a film of plastic material shrunk-wrapped around the exterior of the article 22, both to provide an attractive exterior package and to assist it in retaining its shape. It also prevents the infusion of water, i.e. provides an hermetic package. This type of packaging 24 can be used when the compressed condition will not be maintained for a long period of time either because of an inherent quality in the article or because of the nature of the compression step.

Four examples of the application of the present invention will now be discussed in relation to different types of woven sheet articles.

For these examples, the mould body 12 had an internal diameter of 2.24".

EXAMPLE 1

This first example was carried out on tube socks sold under the brand name "Family Dollar". The socks were 21" in length and normally of size 10–15. The material of the socks comprised 80% cotton and 20% polyester. The following Table 1 gives the results obtained:

TABLE 1

| | SECONDS: | | | | | | | | | | | |
|---|---|---|---|---|---|---|---|---|---|---|---|---|
| PSI | .5/ | 1/ | 1.5/ | 2/ | 2.5/ | 3/ | 3.5/ | 4/ | 4.5/ | 5/ | 5.5/ | 6 |
| 700 | CU | CU | CU | CU | CU | CU | CU | CU | CU | CU | CU | CU |
| 800 | CU | CU | CU | CU | CU | CU | CU | CU | CU | CU | CU | CU |
| 900 | CU | CU | CU | CU | CU | CU | CU | CU | CU | CU | CU | CU |
| 1000 | CU | CU | CU | CU | CU | CU | CU | CU | CU | CU | CU | CU |
| 1100 | CU | CU | CU | CU | CU | CU | CU | CU | CU | CU | CU | CU |
| 1200 | CU | CU | CU | CU | CU | CU | CU | CU | CU | CU | CU | CU |
| 1300 | CU | CU | CU | CU | CU | CU | CU | CU | CU | CU | CU | CU |
| 1400 | CU | CU | CU | NWR | NWR | NWR | NWR | NWR | NWR | NWR | NWR | NWR |
| 1500 | NWR | NWR | NWR | NWR | NWR | NWR | NWR | NWR | NWR | NWR | NWR | NWR |
| 1600 | NWR | NWR | NWR | NWR | NWR | NWR | NWR | NWR | NWR | NWR | NWR | NWR |
| 1700 | NWR | NWR | NWR | NWR | NWR | NWR | NWR | NWR | NWR | NWR | NWR | NWR |
| 1800 | NWR | NWR | NWR | NWR | NWR | NWR | NWR | NWR | NWR | NWR | NWR | NWR |
| 1900 | NWR | NWR | NWR | NWR | NWR | NWR | NWR | NWR | NWR | NWR | NWR | NWR |
| 2000 | NWR | NWR | NWR | NWR | NWR | NWR | NWR | NWR | NWR | NWR | NWR | NWR |
| 2100 | NWR | NWR | NWR | NWR | NWR | NWR | NWR | NWR | NWR | NWR | NWR | NWR |
| 2200 | NWR | NWR | NWR | NWR | NWR | NWR | NWR | NWR | NWR | NWR | NWR | NWR |
| 2300 | NWR | NWR | NWR | NWR | NWR | NWR | NWR | NWR | NWR | NWR | NWR | NWR |
| 2400 | NWR | NWR | NWR | NWR | NWR | NWR | NWR | NWR | NWR | NWR | NWR | NWR |
| 2500 | NWR | NWR | NWR | NWR | DO | DO | DO | DO | DO | DO | DO | DO |
| 2600 | DO | DO | DO | DO | DO | DO | DO | DO | DO | DO | DO | DO |
| 2700 | DO | DO | DO | DO | DO | DO | DO | DO | DO | DO | DO | DO |
| 2800 | DO | DO | DO | DO | DO | DO | DO | DO | DO | DO | DO | DO |
| 2900 | DO | DO | DO | DO | DO | DO | DO | DO | DO | DO | DO | DO |
| 3000 | DO | DO | DO | DO | DO | DO | DO | DO | DO | DO | DO | DO |

In this Table 1, and also the data in the following Tables and four examples, the following abbreviations apply:

CU = Compaction unsuccessful

NWR = No water required for recovery of original shape

WR = Water required for recovery of original shape

DO = Damage occurred

As for all of the tests, the time employed varied from 0.5 seconds through to 6 seconds, at 0.5 second increments. The pressure in this example was varied from 700 to 3,000 psi. As can be seen, there is a broad range of values, denoted by NWR, where satisfactory compaction was achieved, without requiring water to enable an end user to recover the socks to their original un-compacted condition. This condition is alternatively defined as "air recovery".

Thus, at pressures of 1,300 psi or less, the compaction was always unsuccessful, irrespective of the time. Similarly, for pressures of 2,600 psi or greater, damage occurred in all samples, irrespective of the duration of the time.

For pressures in the range 1,400–2,500 psi, successful compaction occurred. However, for the 1,400 psi and 2,500 psi values, compaction was only successful for certain time ranges. Thus, as might be expected, for the lower pressure, a greater time was required, and time of at least 2 seconds is required to get successful compaction at this pressure. Certainly, for the high pressure, long duration of compaction results in damage. Thus, at 2,500 psi, the pressure can only be applied for 2 seconds at the most, to avoid damage. In the narrower pressure range from 1,500 to 2,400, successful compaction occurred at all times in the chart.

It should be noted that longer times, e.g. 10 seconds were tried, and it was discovered that, as a general rule, the longer the stay time the more likely damage was to occur.

It is interesting to note that it is found that there was no point which required water to cause the socks to return to their original condition without damage. Either they could be recovered to their original condition without water, i.e. air recovered, or damage occurred.

For this example, the socks were inserted into the mould or die by rolling each sock individually from the top down. Two sock units were inserted into the die at a time, with the axis of the two rolled socks along the mould axis, so that the compacted article 22 comprised two compressed socks. This gave a disc shape having approximately the mould diameter of 2.24" and a thickness of 0.625" which varied slightly. Later tests showed that the manner in which the socks were rolled was immaterial, and indeed satisfactory compaction could be achieved if the socks were simply randomly inserted into the cavity 14.

EXAMPLE 2

This second example was carried out using face cloths marketed under the brand name St. Mary's Fieldcrest Cannon. They had a composition of 90% cotton and 10% polyester. Again, two units of face cloths were inserted into the cavity 14 for each compaction. The following results were obtained:

TABLE 2

| | SECONDS: | | | | | | | | | | | |
|---|---|---|---|---|---|---|---|---|---|---|---|---|
| PSI | .5/ | 1/ | 1.5/ | 2/ | 2.5/ | 3/ | 3.5/ | 4/ | 4.5/ | 5/ | 5.5/ | 6 |
| 700 | CU | CU | CU | CU | CU | CU | CU | CU | CU | CU | CU | CU |
| 800 | CU | CU | CU | CU | CU | CU | CU | CU | CU | CU | CU | CU |
| 900 | CU | CU | CU | CU | CU | CU | CU | CU | CU | CU | CU | CU |
| 1000 | CU | CU | CU | CU | CU | CU | CU | CU | CU | CU | CU | CU |
| 1100 | CU | CU | CU | CU | CU | CU | CU | CU | CU | CU | CU | CU |
| 1200 | CU | CU | CU | CU | CU | CU | CU | CU | CU | CU | CU | CU |
| 1300 | CU | CU | NWR | NWR | NWR | NWR | NWR | NWR | NWR | NWR | NWR | NWR |
| 1400 | NWR | NWR | NWR | NWR | NWR | NWR | NWR | NWR | NWR | NWR | NWR | NWR |
| 1500 | NWR | NWR | NWR | NWR | NWR | NWR | NWR | NWR | NWR | NWR | NWR | NWR |
| 1600 | NWR | NWR | NWR | NWR | NWR | NWR | NWR | NWR | NWR | NWR | NWR | NWR |
| 1700 | NWR | NWR | NWR | NWR | NWR | NWR | NWR | NWR | NWR | NWR | NWR | WR |
| 1800 | WR | WR | WR | WR | WR | WR | WR | WR | WR | WR | WR | WR |
| 1900 | WR | WR | WR | WR | WR | WR | WR | WR | WR | WR | WR | WR |
| 2000 | WR | WR | WR | WR | WR | WR | WR | WR | WR | WR | WR | WR |
| 2100 | WR | WR | WR | WR | WR | WR | WR | WR | WR | WR | WR | WR |
| 2200 | WR | WR | WR | WR | WR | WR | WR | WR | WR | WR | WR | WR |
| 2300 | WR | WR | WR | WR | WR | WR | WR | WR | WR | WR | WR | WR |
| 2400 | WR | WR | WR | WR | WR | WR | WR | WR | WR | WR | WR | WR |
| 2500 | WR | WR | WR | WR | WR | WR | WR | WR | WR | WR | WR | WR |
| 2600 | WR | WR | WR | WR | WR | WR | WR | WR | WR | WR | WR | WR |
| 2700 | WR | WR | WR | WR | WR | WR | WR | WR | WR | WR | WR | WR |
| 2800 | WR | WR | WR | WR | WR | WR | DO | DO | DO | DO | DO | DO |
| 2900 | DO | DO | DO | DO | DO | DO | DO | DO | DO | DO | DO | DO |
| 3000 | DO | DO | DO | DO | DO | DO | DO | DO | DO | DO | DO | DO |

In this case, it was found that, with two face cloths per stroke, the face cloths were compacted to a height of ½".

As the results show, a wide range of pressure values were obtained in which the face cloths could be recovered to their un-compacted form, although approximately two-thirds of these required water to recover the face cloths. Clearly, for face cloths, the use of water is not always undesirable, but nonetheless the intention of the invention is to provide a method which does not require water for recovery. It is also to be borne in mind that, where water is required, it can take time for the water to be absorbed sufficiently for the face cloths to be pulled out of their compacted form. Where water is not required, it is often quicker to return the relevant article to its un-compacted form.

For this example, acceptable pressures ranged from 1,300 to 2,800 psi. At the lower pressure of 1,300 psi, the minimum time to obtain satisfactory compaction was one and one-half seconds, whilst at the upper limit of 2,800 psi, the acceptable compaction time was three seconds or less. At the lower pressure below one and one-half seconds, compaction was unsuccessful, whilst damage occurred for times of three and one-half seconds or longer at the higher pressure.

Also, it was generally found that at pressures equal to or greater than 1,800 psi, water was required to recover the shape of the face cloths. Although, it should be noted that at the upper time limit of six seconds in Table 2, water was necessary for recovery at a pressure of 1,700 psi.

Again, in general the longer the stay time for the pressure, the greater the chance that damage would occur. At times of ten seconds or greater, it was found that the chance of damage occurring was greatly increased.

EXAMPLE 3

This example was carried out using shop cloth comprising 100% cotton, and marketed under the brand name Milliken & Kex. The results are tabulated in Table 3 below.

TABLE 3

| | SECONDS: | | | | | | | | | | | |
|---|---|---|---|---|---|---|---|---|---|---|---|---|
| PSI | .5/ | 1/ | 1.5/ | 2/ | 2.5/ | 3/ | 3.5/ | 4/ | 4.5/ | 5/ | 5.5/ | 6 |
| 700 | CU | CU | CU | CU | CU | CU | CU | CU | CU | CU | CU | CU |
| 800 | CU | CU | CU | CU | CU | CU | CU | CU | CU | CU | CU | CU |
| 900 | CU | CU | CU | CU | CU | CU | CU | CU | CU | CU | CU | CU |
| 1000 | CU | CU | CU | CU | CU | CU | CU | CU | CU | CU | CU | CU |
| 1100 | CU | CU | CU | CU | CU | CU | CU | CU | CU | CU | CU | CU |
| 1200 | CU | CU | CU | CU | CU | CU | CU | CU | CU | CU | CU | CU |
| 1300 | CU | CU | CU | CU | CU | CU | CU | CU | CU | CU | CU | CU |
| 1400 | CU | CU | CU | CU | NWR | NWR | NWR | NWR | NWR | NWR | NWR | NWR |
| 1500 | NWR | NWR | NWR | NWR | NWR | NWR | NWR | NWR | NWR | NWR | NWR | NWR |
| 1600 | NWR | NWR | NWR | NWR | NWR | NWR | NWR | NWR | NWR | NWR | NWR | NWR |
| 1800 | NWR | NWR | NWR | NWR | NWR | NWR | NWR | NWR | NWR | NWR | NWR | NWR |
| 1700 | NWR | NWR | NWR | NWR | NWR | NWR | NWR | NWR | NWR | NWR | NWR | NWR |
| 1900 | NWR | NWR | NWR | NWR | NWR | NWR | NWR | NWR | NWR | NWR | NWR | NWR |
| 2000 | NWR | NWR | NWR | NWR | NWR | NWR | NWR | NWR | NWR | NWR | NWR | NWR |

TABLE 3-continued

| | SECONDS: | | | | | | | | | | | |
|---|---|---|---|---|---|---|---|---|---|---|---|---|
| PSI | .5/ | 1/ | 1.5/ | 2/ | 2.5/ | 3/ | 3.5/ | 4/ | 4.5/ | 5/ | 5.5/ | 6 |
| 2100 | NWR | NWR | NWR | NWR | NWR | NWR | NWR | NWR | NWR | NWR | NWR | WR |
| 2200 | WR | WR | WR | WR | WR | WR | WR | WR | WR | WR | WR | WR |
| 2300 | WR | WR | WR | WR | WR | WR | WR | WR | WR | WR | WR | WR |
| 2400 | WR | WR | WR | WR | WR | WR | WR | WR | WR | WR | WR | WR |
| 2500 | WR | WR | WR | WR | WR | WR | WR | WR | WR | WR | WR | WR |
| 2600 | WR | WR | WR | WR | WR | WR | WR | WR | WR | WR | WR | WR |
| 2700 | WR | WR | WR | WR | WR | WR | WR | WR | DO | DO | DO | DO |
| 2800 | DO | DO | DO | DO | DO | DO | DO | DO | DO | DO | DO | DO |
| 2900 | DO | DO | DO | DO | DO | DO | DO | DO | DO | DO | DO | DO |
| 3000 | DO | DO | DO | DO | DO | DO | DO | DO | DO | DO | DO | DO |

Again, two units of cloths were compacted per stroke, to give a finished thickness of three-quarters of an inch. The test was carried out by rolling the cloths and randomly placing the cloths in the cavity 14. This is not found to make any difference to the compaction.

Again, the broad range of acceptable pressures is from 1,400 to 2,700 psi. At the lower range of 1,400, it was found that the lowest time to give acceptable compaction was two and one-half seconds. Correspondingly, at the upper pressure of 2,700 psi, the maximum time to give acceptable compaction, without damage occurring, was four seconds.

Similarly to the second example, the lower part of the pressure range provided recovery without the use of water or air recovery, whilst the upper part of acceptable pressure range requires water for recovery. The division between these two parts occurs between the pressures of 2,100 and 2,200 psi. At the maximum time of 6 seconds with a pressure of 2,100 psi it was also found that water was required to recover the shop cloths.

Tables 1, 2 and 3 can be compared, since they relate to articles formed from cotton or a cotton/polyester blend. Thus, table 3 is a pure 100% cotton composition, whilst table 2 is a 90% cotton/10% polyester blend and table 1 is a 80% cotton/20% polyester blend.

The broad range of acceptable pressures is very similar for these three examples. Generally, a pressure of 1,300–1,400 psi or greater was found to give acceptable compaction, provided the stay or compaction time was sufficiently long. The second example, in fact, could be compacted successfully at a slightly lower pressure of 1,300 psi.

The acceptable upper pressure is also comparable in all three examples being in the range 2,500–2,800 psi for the three examples, depending upon the stay time.

Acceptable pressures at a time of 5 seconds should be considered, since this time often corresponds to the timing of other steps in a packaging operation. At 5 seconds, the acceptable lower pressure was 1,400 psi for both examples 1 and 3, and 1,300 for example 2. The acceptable upper pressure was 2,400, 2,700 and 2,600 for examples 1, 2 and 3 respectively. If one took a pressure of 1,500 or 1,600 psi at 5 seconds, it would fall comfortably within the acceptable ranges for no water or air recovery for all three examples.

For the shop cloths of example 3, it should be noted that these shop cloths are often shipped in bulk to an end user, usually a large industrial plant. The cloths are then often laundered and treated prior to use.

To reduce shipping and transportation costs, it would be desirable to reduce the volume and bulk of the shop cloths. Accordingly, it is proposed to compress the shop cloths in large quantities into blocks containing as many as 200 shop cloths. Despite the fact that they are laundered prior to use, it is considered undesirable to require water to recover the cloths from the compressed block, or it takes considerable time for water to be absorbed into such a large block of compressed cloths. It is therefore preferred for the cloths to be capable of being separated by air recovery, i.e. without the use of water or other liquid.

A further advantage of compressing an article such as shop cloths, and indeed this applies to many other articles, is that it makes it more compact and hence more suitable for display and sale at a retail level. Shop cloths are relatively inexpensive items, and retailers are reluctant to give any prominent shelf space to such a low value item, when they could instead stock higher value items giving a better return. It is intended that compacted shop cloths, compacted individually or in small quantities, could be more easily handled at the retail level and make better use of shelf space. Further, they could be readily displayed at point of sale locations, to encourage purchase by occasional or impulsive buyers.

EXAMPLE 4

This fourth example was carried out on pantyhose, namely pantyhose marketed under the brand name Leggs Sheer Energy 5B Sun Tan. The composition of the material was: hose, 19% spandex wrapped with 81% nylon; panty, 95% nylon with 5% spandex; and gusset, 55% cotton with 45% polyester. The results are tabulated in the following table 4.

TABLE 4

| | SECONDS: | | | | | | | | | | | |
|---|---|---|---|---|---|---|---|---|---|---|---|---|
| PSI | .5/ | 1/ | 1.5/ | 2/ | 2.5/ | 3/ | 3.5/ | 4/ | 4.5/ | 5/ | 5.5/ | 6 |
| 700 | CU | CU | CU | CU | CU | CU | CU | CU | CU | CU | CU | CU |
| 800 | CU | CU | CU | CU | CU | CU | CU | CU | CU | CU | CU | CU |
| 900 | CU | CU | CU | CU | CU | CU | CU | CU | CU | CU | CU | CU |
| 1000 | CU | CU | CU | CU | CU | CU | CU | CU | CU | CU | CU | CU |
| 1100 | CU | CU | CU | CU | CU | CU | CU | CU | CU | CU | CU | CU |
| 1200 | CU | CU | CU | CU | CU | CU | CU | CU | CU | CU | CU | CU |
| 1300 | CU | CU | CU | CU | CU | CU | CU | CU | CU | CU | CU | CU |
| 1400 | CU | CU | CU | CU | CU | CU | CU | CU | CU | CU | CU | CU |
| 1500 | CU | CU | CU | CU | CU | CU | CU | CU | CU | CU | CU | CU |

TABLE 4-continued

| | SECONDS: | | | | | | | | | | | |
|---|---|---|---|---|---|---|---|---|---|---|---|---|
| PSI | .5/ | 1/ | 1.5/ | 2/ | 2.5/ | 3/ | 3.5/ | 4/ | 4.5/ | 5/ | 5.5/ | 6 |
| 1600 | CU | CU | CU | CU | CU | CU | CU | CU | CU | CU | CU | CU |
| 1700 | CU | CU | CU | CU | CU | CU | CU | CU | CU | CU | CU | CU |
| 1800 | CU | CU | CU | CU | CU | CU | CU | CU | CU | CU | CU | CU |
| 1900 | CU | CU | CU | CU | CU | CU | CU | CU | CU | CU | CU | CU |
| 2000 | CU | CU | CU | CU | CU | CU | CU | CU | CU | CU | CU | CU |
| 2100 | CU | CU | CU | CU | CU | CU | CU | CU | CU | CU | CU | CU |
| 2200 | CU | CU | CU | CU | CU | CU | CU | CU | CU | CU | CU | CU |
| 2300 | CU | CU | CU | CU | CU | CU | CU | CU | CU | CU | CU | CU |
| 2400 | CU | CU | CU | CU | CU | CU | CU | CU | CU | CU | CU | CU |
| 2500 | CU | CU | CU | CU | CU | CU | CU | CU | CU | CU | CU | CU |
| 2600 | CU | CU | CU | CU | CU | CU | CU | CU | CU | CU | CU | CU |
| 2700 | CU | CU | CU | CU | CU | CU | CU | CU | CU | CU | CU | CU |
| 2800 | CU | CU | CU | CU | NWR | NWR | NWR | NWR | NWR | NWR | NWR | NWR |
| 2900 | NWR | NWR | NWR | NWR | NWR | NWR | NWR | NWR | NWR | NWR | NWR | NWR |
| 3000 | NWR | NWR | NWR | NWR | NWR | NWR | NWR | NWR | NWR | NWR | NWR | NWR |
| 3100 | NWR | NWR | NWR | NWR | NWR | NWR | NWR | NWR | NWR | DO | DO | DO |
| 3200 | DO | DO | DO | DO | DO | DO | DO | DO | DO | DO | DO | DO |

As for the earlier examples, two units were compacted per stroke, to give a compacted disc shape with a height of one and three-quarter inches. The pantyhose was rolled from toe to panty prior to insertion into the cavity.

As the table shows, the range of acceptable pressures was relatively narrow, and at relatively high pressures. Further, note as for table 1, no point was found where water was required to recover the article, since damage occurred before such a condition was found.

The range of acceptable pressures range from 2,800 psi to 3,100 psi. At the lower limit of 2,800 psi, the minimum stay time for successful compaction is two and one-half seconds, whilst at the upper limit of 3,100 psi, the maximum stay time to avoid damage occurring is four and one-half seconds.

Again, bearing in mind a desirable time of 5 seconds, to fit into the cycle of other packaging machinery, the pressure of 2,800 psi is preferred, since this falls in the middle of the band of acceptable pressures at 5 seconds. The use of this pressure should ensure successful compaction, without any damage occurring.

It will be appreciated that whilst examples have been given for certain selected materials, the pressures and stay times can be varied dependent upon the material of the article. In general, this will depend upon the actual composition of the material of the article, as well as the nature of the article, i.e. whether it is loosely or tightly woven, etc. A person skilled in this art can readily determine acceptable pressures for different articles.

Whilst the invention has been described by way of example, in relation to certain specific materials and articles, it will be appreciated that it is applicable to wide variety of materials. Thus, a variety of textiles could be compressed and packaged in accordance with the present invention. Such textiles include blankets, beach towels, mattress covers.

Further, the invention is believed to be particularly applicable to the packaging of both disposable and reusable cotton baby diapers. Particularly for disposable diapers, the diapers are quite bulky, which results in excessive packaging, handling and transportation costs. If their volume could be reduced, the costs of handling, transportation, etc. could be reduced. Further, an end-user or purchaser could more readily handle a package of compressed diapers.

In this respect, the term "woven sheet article" is to be construed in this specification including the claims as encompassing the fibrous material of disposable diapers.

Similar advantages can be obtained for reusable, woven, cloth diapers. In this case, it may even prove advantageous for companies providing a diaper service to use the compression and packaging method of the present invention. This again would save on handling and transportation charges, whilst presenting the user with a more attractive package of diapers.

I claim:

1. A method of compressing a woven sheet article comprising a blend of cotton and polyester, to produce a solid, stable, compacted article, the method comprising:

(a) placing the sheet article in a mould;

(b) subjecting the sheet article to an elevated pressure in the range of 1,300 p.s.i. to 2,500 p.s.i. for a certain time, which pressure and time are selected so that the sheet article is compressed to form a stable, substantially rigid, compacted article, which retains substantially the shape of the mould after removal therefrom and which compacted article can be returned to its original un-compacted condition by manipulation thereof without the addition of any liquid; and (c) removing the compacted article from the mould.

2. A method as claimed in claim 1, wherein the material of the article comprises approximately 80% cotton and 20% polyester, and wherein during step (b) the pressure applied is in the range of 1,400 psi to 2,500 psi.

3. A method as claimed in claim 2, wherein during step (b) the pressure is applied for at least two seconds and the pressure is in the range 1,400–2,400 psi.

4. A method as claimed in claim 1, wherein the material of the article comprises 90% cotton and 10% polyester, and wherein during step (b), the applied pressure is in the range of 1,300–1,700 psi.

5. A method as claimed in claim 4, wherein during step (b), the pressure is applied for at least two seconds.

6. A method as claimed in claim 1, when applied to articles which are usually solid in pairs, wherein a pair of said articles are compacted together to form a single compacted article.

7. A method as claimed in claim 1, when applied to shop cloths, wherein a plurality of the shop cloths exceeding 50 are compressed together during step (b) to form a single compacted block of the shop cloths.

8. A method of compressing a woven sheet article comprising 100% cotton, to produce a solid, stable, compacted article, the method comprising: (a) placing the sheet article in a mould; (b) subjecting the sheet article to an elevated pressure in the range of 1,400 psi to 2,100 psi for a certain time, which pressure and time are selected so that the sheet article is compressed to form a stable, substantially rigid, compacted article, which retains substantially the shape of the mould after removal therefrom and which compacted article can return to the original un-compacted condition by manipulation thereof without the addition of any liquid; and (c) removing the compacted article from the mould.

9. A method as claimed in claim 8, wherein during step (b), the pressure is applied for a period of time greater than two seconds.

10. A method of compressing pantyhose having different portions formed from different materials, to produce a solid, stable, compacted article, the method comprising: (a) placing the pantyhose in a mould; (b) subjecting the pantyhose to an elevated pressure in the range of 2,800–3,100 PSI for a certain time, which pressure and time are selected so that the pantyhose is compressed to form a stable, substantially rigid, compacted article, which retains substantially the shape of the mould after removal therefrom and which compacted article can be returned to the original un-compacted condition by manipulation thereof without the addition of any liquid; and (c) removing the compacted article from the mould.

11. A method as claimed in claim 10, wherein the pressure in step (b) is applied for a period of time greater than two seconds, and in the pressure range 2,800–3,000 psi.

12. A method as claimed in claim 3, 5, 9 or 11, wherein during step (b) the pressure is applied for five seconds.

13. A method as claimed in claim 2, 3, 5, 9 or 11, wherein after step (c) the following additional step is effected:

(d) packaging the compacted article in a close-fitting package which substantially seals the article from external moisture and assists in retaining the shape of the compacted article.

14. A method as claimed in claim 3, 5, 9, or 11, wherein the method is applied to a plurality of articles simultaneously, to form a single compacted article incorporating a plurality of the original articles.

* * * * *